United States Patent [19]

Hardy et al.

[11] 4,136,921

[45] Jan. 30, 1979

[54] ADAPTER FOR CB RADIO REPLACEMENT

[76] Inventors: George F. Hardy, 26 Suburban Ave.; Morton E. David, 102 Cliff Ave., both of Pelham, N.Y. 10803

[21] Appl. No.: 832,166

[22] Filed: Sep. 12, 1977

[51] Int. Cl.[2] ..... H01R 13/46

[52] U.S. Cl. ..... 339/141; 339/154 A; 339/182 R

[58] Field of Search ..... 339/89 R, 89 M, 141, 339/154 R, 154 A, 176 M, 182 R, 184 R, 196 RM, 204, 205, 206 R, 206 P, 208

[56] References Cited

U.S. PATENT DOCUMENTS

| | | | |
|---|---|---|---|
| 2,905,922 | 9/1959 | Tucher | 339/141 |
| 3,281,558 | 10/1966 | Weber | 339/159 R X |
| 3,659,251 | 4/1972 | Fish | 339/141 X |
| 3,673,546 | 6/1972 | Green et al. | 339/177 R X |

*Primary Examiner*—Roy Lake
*Assistant Examiner*—E. F. Desmond
*Attorney, Agent, or Firm*—Kenneth S. Goldfarb

[57] ABSTRACT

Adapters for use in connecting a single model of a replacement microphone to all makes and models of C B radios. Each adapter includes a shell providing for a female connector at each end of the adapter, screws holding the shell in clamping relationship about said female connectors, a threaded ring for securing the adapter to a C B radio, and electrical conductors operatively electrically connecting the female connectors electrically to each other.

6 Claims, 4 Drawing Figures

ADAPTER FOR CB RADIO REPLACEMENT

BACKGROUND OF THE INVENTION

1. Field of the Invention

This invention relates to an electrical adapter for use in connecting a replacement microphone to a Civilian Band Radio.

2. Description of the Prior Art

Replacement microphones for Civilian Band (C B) radios have been manufactured in the past having five wires projecting for individual connection to the selected number of terminals of the numberous makes and models of radios. The original microphones are quite breakable and subject to much abuse so that these replacement microphones are necessitated. The labor of connecting the wires of the microphones to the C B radio often requires expert knowledge and careful workmanship which substantially adds to the cost of a replacement microphone.

It is the purpose and concept of the present invention to provide a selected adapter for a C B radio so that a common connector can be used on the replacement C B microphone to connect it with any make or model of C B radio.

SUMMARY OF THE INVENTION

The present invention provides for an adapter for connection to a 5 prong male connector of a replacement microphone and to a male connector of a particular selected make and model of C B radio. Each adapter is specificially wired in a correct manner to permit proper electrical connection between radio and microphone permitting one replacement microphone to be used with all C B radios and requiring only a selected adapted usuable with one or more of the many makes and models of C B radios. The adapter features the use of spaced female connector ends clamplingly held together by a composite shell which permits for selective wiring within the shell of the respective connector ends to permit for proper electrical connection between the microphone and the C B radio.

Other features of the invention will become apparent as the following description proceeds, a preferred embodiment being illustrated in the accompanying drawing, by way of example only wherein;

DETAILED DESCRIPTION OF THE INVENTION

Figure 1:
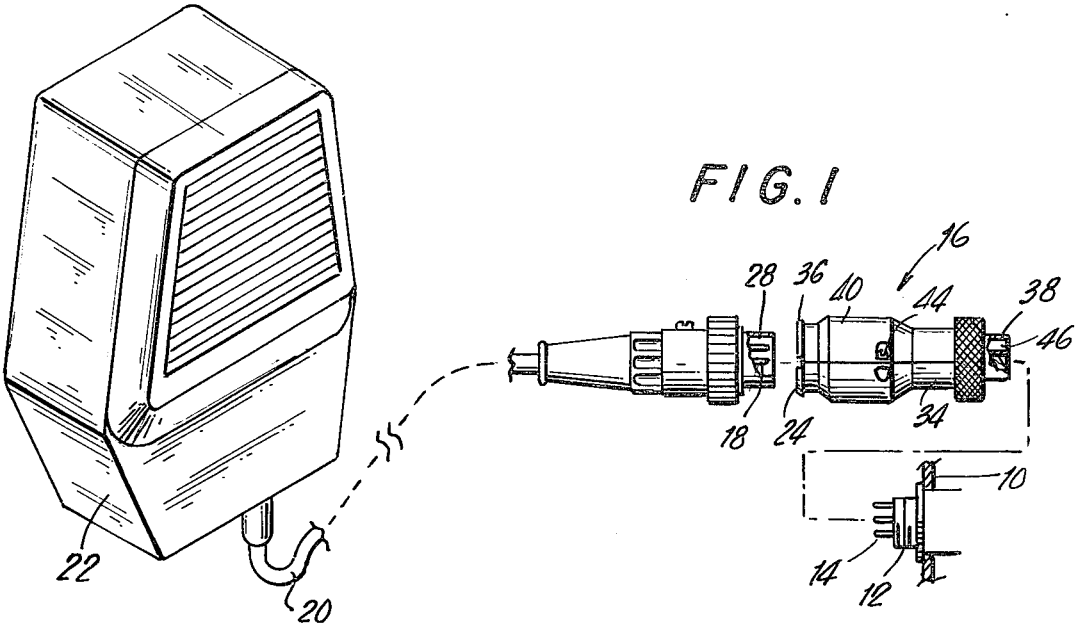
FIG. 1 is on exploded perspective view of the invention showing how the adapter is used to connect a replacement microphone to a C B radio.
Figure 2:
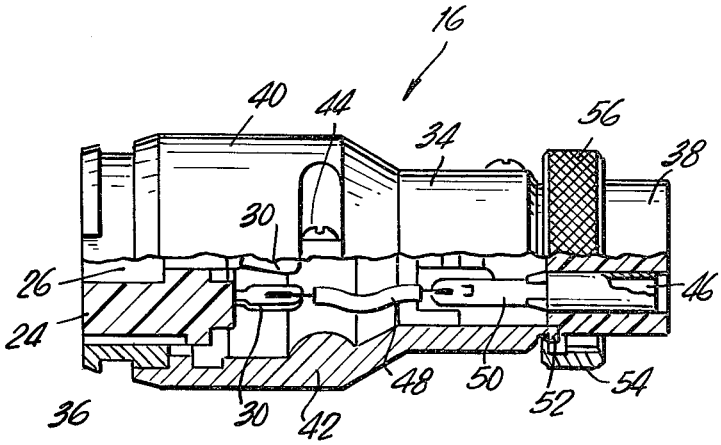
FIG. 2 is a longitudinal sectional view of the adapter.
Figure 3:
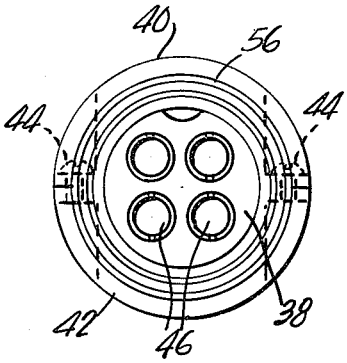
FIG. 3 is a end elevational view of the female connector end used for connection to the C B radio.
Figure 4:
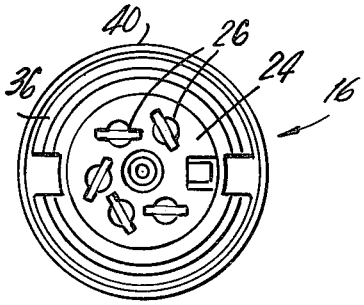
FIG. 4 is an end elevational view of the female connector end for connection to the replacement microphone.

With continuing reference to the accompanying drawing, wherein like reference numerals designate similar parts throughout the various views, reference numeral 10 designates any of the various makes and models of C B radios in use today. Each C B radio has a threaded male connector 12 provided with a particular arrangement of contacts 14 which vary in number and location for detachably receiving the female connector plug of the original microphone made especially for that particular make and model of C B radio. Since the male connectors 12 widely vary between each special C B radio, hereto before it was necessary to individually connect the electrical conductors of the cord of a replacement microphone to the contacts 14 which made for individual labor and a makeshift appearances.

In carrying out the present invention any one of a number of differently wired adaptors 16 are used for connection to the male connector 18 at the end of the cord 20 of a replacement microphone 22. The adapter 16 there by becomes an important element of the invention.

The adapter 16 includes of female connector end 24 in the form of a molded body of insulative plastic material having a pluralty of sockets 26 into which the prongs 28 of connector 18 are adapted to be inserted and which engage a selected number of contacts 30 mounted at the inner ends of sockets 26. The female connector 24 is insulated from the shell 34 by an insulator 36.

A female connector end 38 spaced from the female connector 24 is mounted in the shell 34. The shell 34 is made of corrosion free metal and is formed into half shells 40 and 42 clampingly secrued in overlying relationship about the female connectors by screws 44 on opposite sides of the shell 34. The configuration of the shell permits the connector 24 to be of considerably larger diameter than that of connector 38.

The connector 38 is provided with a selected number of sockets 46 corresponding as necessary to the particular configuration and number of the contacts 14 for the particular make and model of C B radio.

Electrical conductors 48 are used to interconnect the contacts 30 with the contacts 50 mounted in the sockets 46 there up on operatively electrically connecting the prongs 18 through contacts 30, wires 48, contacts 50 to the prongs 14 thereby operatively electrically connecting the replacement microphone 22 with the C B radio 10.

One of the features of the construction of shell 34 is that it is provided with an integrally formed ring 52. A lock nut 54 having a knurled outer surface 56 is slipped over the shell halves 40 and 42 prior assembly. This lock ring is then threadedy secured or attached by bayonet interlock with the male connector 12.

Thus it can be seen that the adapter 16 permits for connection of replacement microphone 22 with any make or model of the adapter. The purchaser of the microphone informs the supplier of the make and model of C B radio with which the microphone is to be used. A suitable adapter is then selected and provided. Of course various modifications of the adapter are within the concept of the invention, only a single adapter being described but all such modifications will fall within the scope of the appended claims.

What is claimed is:

1. An adapter for use in connecting a model of a replacement mirophone to a C B radio comprising a shell having at least two complementary parts, a first female connector end for connection to the replacement microphone, a second female connector end spaced and insulated from said first connector end for connection to the C B radio, means for clampingly securing said shell about said connector ends, and wiring means operatively electrically connecting said connector ends to each other.

2. An adapter according to claim 1, wherein said shell includes complementary half shells, said securing means comprising screws threadedly engaged in said half shells.

3. An adapter according to claim 2, including a threaded locking nut disposed about said shell for threaded engagement with the C B radio.

4. An adapter according to claim 3, wherein said shell includes an integral lock ring to limiting axial movement of said lock nut while permitting rotational movement thereof.

5. An adapter according to claim 4, wherein said lock nut has a knurled outer surface.

6. An adapter according to claim 5, wherein said first connector end is of greater diameter than said second connector end.

* * * * *